United States Patent [19]

Horwood

[11] Patent Number: 4,607,794

[45] Date of Patent: Aug. 26, 1986

[54] CONTROL OF JETS OF LIQUID

[76] Inventor: Norman Horwood, 11, Melville Hall, Holly Road, Edgbaston, Birmingham, England

[21] Appl. No.: 585,775

[22] Filed: Mar. 2, 1984

[30] Foreign Application Priority Data

Mar. 4, 1983 [GB] United Kingdom ..... 8306082

[51] Int. Cl.[4] ..... B05B 1/26

[52] U.S. Cl. ..... 239/455; 239/502; 239/512; 239/596; 239/600; 239/601

[58] Field of Search ..... 239/451, 455, 502, 505, 239/513, 512, 521–523, 596, 599, 600, 601, 507, 524

[56] References Cited

U.S. PATENT DOCUMENTS

| | | | |
|---|---|---|---|
| 177,239 | 5/1876 | Haley | 239/455 |
| 2,125,445 | 8/1938 | Holveck | 239/599 |
| 3,194,014 | 7/1965 | Wilson, Jr. | 239/513 X |
| 4,047,186 | 9/1977 | Kendall et al. | 239/596 X |
| 4,131,236 | 12/1978 | Saunders | 239/596 X |

FOREIGN PATENT DOCUMENTS

| | | | |
|---|---|---|---|
| 144012 | 12/1978 | Japan | 239/596 |

*Primary Examiner*—Andres Kashnikow
*Assistant Examiner*—Mary Beth O. Jones
*Attorney, Agent, or Firm*—Fulwider, Patton, Rieber, Lee & Utecht

[57] ABSTRACT

Apparatus for deflecting a high pressure jet of liquid, comprising the provision of a pair of sharp edged deflecting members secured to a nozzle member in a position such that the sharp edges of the deflecting members protrude into the jet of liquid to shape the jet to the required form. The provision of sharp edged deflecting members obviates the necessity for complex nozzle forms. The relatively simple shape of the deflecting members permits their formation from a hard material by machining or the like in an economical manner.

11 Claims, 8 Drawing Figures

CONTROL OF JETS OF LIQUID

BACKGROUND OF THE INVENTION

1. Field of the Invention

The present invention relates to the control of jets of liquid and is primarily but not exclusively concerned with the deflection of a jet of liquid from its original path or confinement of a jet of liquid to only part of its original path.

Jets of liquid are frequently used in cleaning and cutting operations, liquid under considerable pressure for example 8000 p.s.i. is forced through a nozzle to provide a jet which abraids the surface of an object.

It is desirable that the shape of the jet is controlled so as to be of a shape which is both effective and efficient in use.

2. Description of the Prior Art

The orifice in a nozzle has in the past been formed to provide the desired shape of jet, and it has been known to make the nozzle from two interfitting parts to assist in the ease of manufacture thereof.

Abrasion of the surfaces of the nozzle by the fluid itself may not be too severe, however, any foreign matter in the liquid, the addition of which is likely, particularly in a cleaning operation, may cause rapid erosion of the surfaces of the nozzle and especially those surfaces adapted to shape the jet and which "interfere" with the fluid flow to produce the desired shape of the jet of liquid.

The above mentioned inherent problems may necessitate the frequent replacement of the jet forming nozzle.

It is imperative therefore that jet forming nozzles are manufactured from a hard material so as to withstand the wear which in use they are subjected. The hardness of the material and, in some cases the complex shape of the orifice necessary to produce the desired jet form make the manufacture of such a nozzle an expensive operation.

It is an object of the present invention to provide a new or improved apparatus for deflecting the path of a jet of liquid.

SUMMARY OF THE INVENTION

According to one aspect of the present invention, I provide apparatus for deflecting a jet of liquid comprising:

(a) a nozzle member
(b) an orifice in said nozzle through which liquid may pass to form said jet
(c) a sharp edged deflecting member;
(d) mounting means enabling mounting of said deflecting member relative to said jet, in a position such that said sharp edge of the deflecting member is disposed in the path of said jet;
(e) securing means for securing said deflecting member relative to said nozzle in special jet deflecting position.

The sharp edge of the deflecting member is preferably as sharp as possible the "thickness" of the sharp edge may depend on the diameter of the jet orifice, the material from which the deflecting member is made and the working pressure of the jet. It is possible, particularly with a nozzle orifice diameter of about 1 mm that the sharp edge of the or each deflecting member may be formed with a land so that the edge presents a definitive thickness of, for example 0.1 mm and with nozzles of greater diameter e.g. 5 mm the sharp edge of the deflecting member may have a land of about 0.5 mm.

Said deflecting member is preferably mounted in proximity to an outer end of the jet forming orifice in a nozzle and conveniently said deflecting member is positioned in abutting relationship with the nozzle in which said orifice is formed.

Preferably two of said deflecting members are provided each deflecting member having a sharp edge.

The or each deflecting member may be located or secured to a plate member the arrangement being such that in use said deflecting members are sandwiched between said nozzle and said plate member said plate member having a configuration so as not to interfere with said jet, means being provided to secure said plate member together with the or each deflecting members relative to the nozzle.

Alternatively, the or each deflecting member may be provided with a respective locating and securing means so that the position of each deflecting member relative to the jet path may be altered.

The apparatus of the present invention permits the deflecting members, which in practice is the part subject to the most wear, to be manufactured independently from the jet nozzle itself and, since it is formed as a separate entity it may be replaced when necessary. The manufacture of the deflecting members is a simpler operation than the complex machining necessary to form an orifice in a nozzle which is capable of forming a special shape of jet.

Since the or each deflecting member may be formed separately from the nozzle the shape of each deflecting member or at least its deflecting edge may be of any suitable desired form, for example straight, curved, either convex or concave, or it may be of irregular form. The shape of the deflecting edge of the deflecting members is thus able to be formed into shapes which with an integral deflecting nozzle unit was not previously possible.

The present invention also permits the deflecting members to be made from a very hard material, for example tungsten carbide the same material may be used for the nozzle. Furthermore better access to the deflecting edges allows for special treatment to ensure that the surfaces which come into contact with the jet of liquid may be as smooth as possible which greatly increases the efficiency of the jet.

Furthermore, since the deflecting members may be removed from the nozzle a single nozzle may be used with different deflecting members to form different jets as desired or to enable the same jet to be produced from different liquids and for different pressures.

An unexpected advantage is obtained, from the construction of the jet deflecting apparatus of the present invention. The jet deflecting members may be secured to the nozzle so that the sharp edge of the deflecting member projects into the path of the jet substantially at right angles.

Such positioning of the deflecting member has the effect of causing considerable divergence from its original path of the jet and, particularly where two deflecting members are provided not only causes the jet to either be diverted to a new desired path, or constrained to a part of its original path but causes considerably increased "cavitation" in the jet of liquid, that is discontinuity in the flow of liquid by the formation of very small bubbles of air, vapour, gas or a combination of same at very low pressure i.e. "vacuum bubbles" the presence of which tends to force the liquid forming the jet to collapse implosively into such vacuum bubbles.

When such a jet in which cavitation is occurring strikes a surface a hammer like action is provided due to the collapsing bubbles which greatly enhances the abrasive effect of the jet.

It would be expected that the intrusion substantially at right angles of deflecting members into the jet is highly detrimental to the efficiency of flow and that very high pressures are needed to sustain the energy of the jet subsequent to being deflected by the deflecting members. Contrary to such expectation it has been found that because of the positioning and ability to provide highly polished surface treatment to the deflecting members the efficiency of the jet, which may be measured in terms of the energy of the jet subsequent to deflection compared with the energy input is not only as good as known jets in which a contoured nozzle profile to produce the desired shape is provided, but, is significantly better.

BRIEF DESCRIPTION OF THE DRAWINGS

The invention will now be described in more detail by way of example only with reference to the accompanying drawings wherein.

DESCRIPTION OF THE PREFERRED EMBODIMENTS

Figure 1:
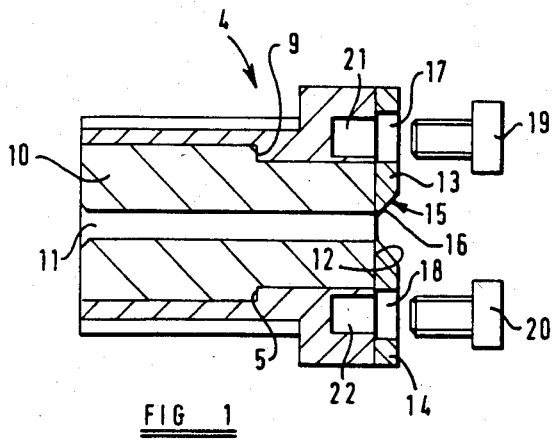
FIG. 1 is a sectional view illustrating one embodiment of the present invention.

Referring first to FIG. 1, a liquid jet forming apparatus comprises a body part 4 made, for example, from a machinable steel, in which body part 4 is located a nozzle 10. The nozzle 10 is made from a very hard material, for example tungsten carbide, and can be located within the body 4 in any suitable way, for example by abutting annular shoulders 5 on the body 4 and 9 on the nozzle 10.

The nozzle 10 has a orifice 11 through which fluid may pass to form a jet. The outer surface 12 of the nozzle 10 has secured thereto a pair of deflecting members 13 and 14 to change the shape of the jet that would otherwise have issued from orifice 11. The jet will be deflecting to form a "fan" shaped jet.

The deflecting member 13 has a chisel shaped end region 15 terminating in a sharp edge 16 which projects into the path of the jet. The presence of the sharp edge 16 prevents the jet of liquid adhering by capillary action to the deflecting member 13. The shape of the deflecting member 14 may be identical to that of the deflecting member 13 as shown in FIG. 1 or alternatively may be of any other desired configuration to vary the shape of the jet of liquid.

Each of the deflecting members 13 and 14 has a respective slot 17 and 18 the slots having a configuration such that with the deflecting members 13 and 14 in the position shown the slots extend substantially radially to the axis of orifice 11.

Locating and securing means in the form of a pair of headed machine screws 19 and 20 are provided which machine screws are threadedly engaged in respective threaded bores 21 and 22 in the body part 4. The arrangement being such that each of the deflecting members 13 and 14 may be positioned on the face 12 of the nozzle 10 so that they project by the amount desired into the path of the jet of liquid to produce the desired configuration of jet, the machine screws 19 and 20 then being tightened so that each of the deflecting members 13 and 14 are clamped between the outer surface 12 of body part 4 and the underside of the head of the respective machine screw.

Figure 2:
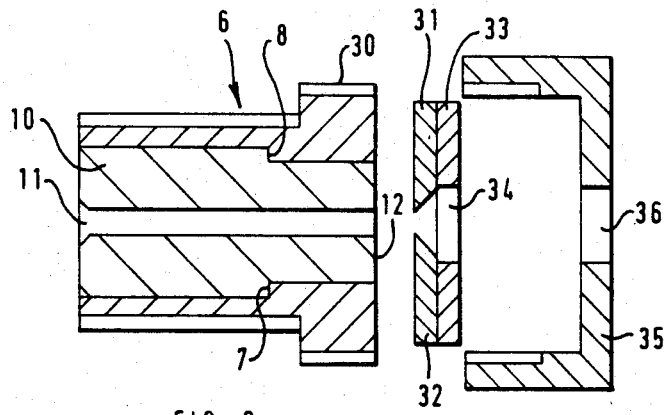
FIG. 2 is a sectional view illustrating a second embodiment of the invention.

Referring now to FIG. 2 an alternative form of deflecting apparatus is shown.

The apparatus comprising a body part 6 similar to the body part 4 shown in FIG. 1. The body part 6 has located therein a nozzle 10, the same as that shown in FIG. 1, the nozzle 10 being located relative to the body part 6 by a shoulder 8 on the nozzle and 7 on the body part 6. A helical thread form 30 is provided on the outer circumferential surface of the body part 6.

Deflecting members 31 and 32 are provided and are secured to plate member 33. The plate member 33 has an aperture 34 of a size such that the jet will not impinge on the surfaces of the plate member 33.

The deflecting members 31,32 may be secured to the plate member 33 by any desirable method, for example a threaded fastener, an adhesive, welding or mechanical location means.

The deflecting members 31,32 may be fixed relative to the plate member 33 or some provision for movement may be provided either variable, i.e. sliding movement or incremental, for example by the provision of locating abutments on the deflecting members 31, 32 or the plate member 33 and corresponding indentations or other irregularities in the plate member 33 or deflector members 31 and 32 respectively.

The deflector members 31 and 32 and plate member 33 are held in position in abutment with face 12 of nozzle 10 i.e. threaded engagement of cap 35 with the thread form 30 on the body part 6. The cap 35 is provided with an aperture 36 in the centre thereof of sufficient size to prevent any engagement of the jet with any surface of the cap 35 thus preventing any undesired interference with the shape and form of the jet.

The diameter of plate member 33 may either be such that it closely conforms to the internal diameter of cap member 35 thus preventing any relative sliding movement other than relative rotational movement or alternatively as shown the plate member 33 may have a lesser diameter than the internal diameter of the cap 35 and/or alternatively may be non-circular in order that limited translatory sliding movement relative to the cap member 35 is possible. Such provision for movement enabling the deflecting members 31 and 32 together with the plate member 33 to be adjusted before the cap member 35 is tightened to lock the plate 33 and deflector plates 31 and 32 in their desired position.

In the event of wear of the deflector members 31 and 32, it is a simple operation merely to remove the cap 35 take out the plate member 33, complete with deflecting members 31 and 32 and insert a new assembly of plate member with accompanying deflecting members. Similarly, if it is required to produce a different form of jet the plate member and deflecting members may be removed and replaced with others of a different configuration or spacing to produce the different desired shape of jet.

Whereas in both embodiments the face of the deflecting members 13 and 14 and 31 and 32 which abutts the surface 12 of the nozzle 10 has been shown as being substantially flat, the region of the face abutting the face 12 of nozzle 10 adjacent a slot or gap defined by the opposed sharp edges of the deflecting members may be undercut or otherwise profiled to further improve or influence the jet to attain the desired form.

Figure 3:
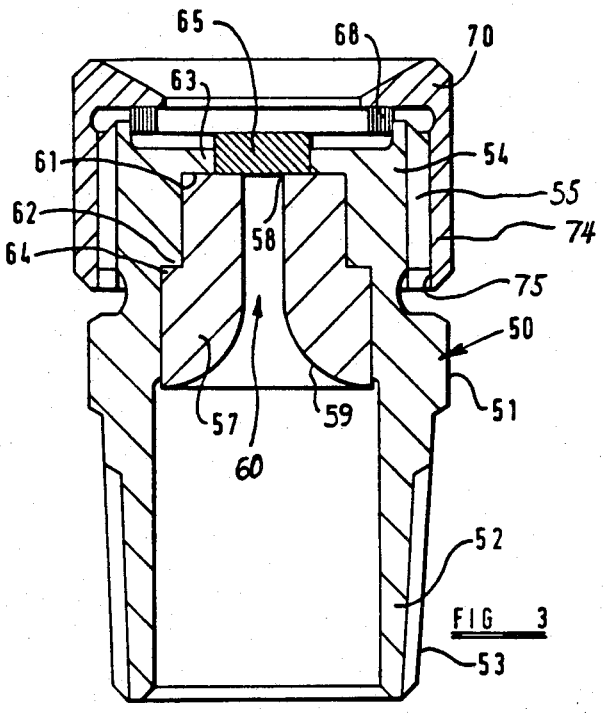
FIG. 3 is a sectional view through a further embodiment of the invention
Figure 4:
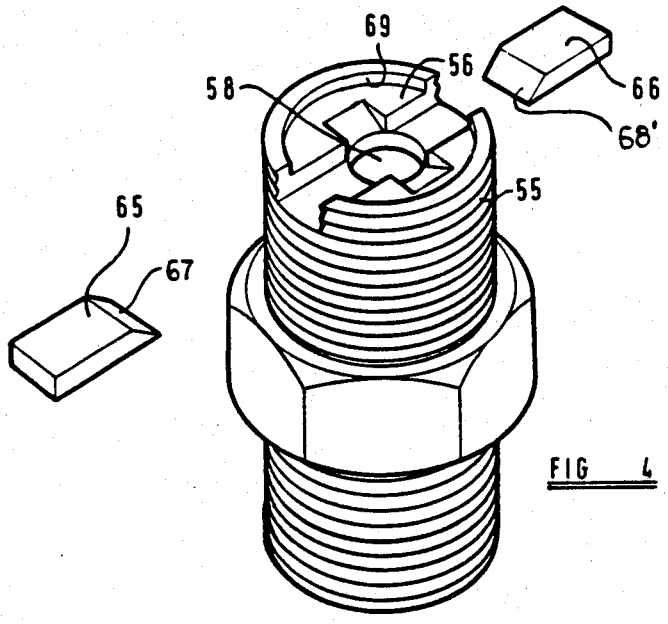
FIG. 4 is a perspective view of the body part of the embodiment shown in FIG. 3.

Referring now to FIGS. 3, and 4 an alternative embodiment of jet deflecting apparatus is shown, and comprises a body part indicated generally at 50, the body part 50 having a central part 51 which is hexagonal in cross-section and an inner end part 52, having helical thread 53 and an outer end part 54 having a helical thread 55.

The outer end part 54 has an end face generally indicated at 56.

Located within the body part 50 is a nozzle part 57 provided with an orifice 58 the orifice 58 having a tapered entry region 59 leading to the jet forming passage 60 which is oval in cross-section.

The nozzle part 57 is removably secured in the body part 51 and is located by abutment faces 61 and 62 on the nozzle 57 and 63 and 64 on the body part respectively.

The deflecting members 65 and 66 are located in a channel shaped recess formed in the end face 56 of body part 50.

The deflecting member 65 and 66 may be arranged so that they are either slidably moveable relative to the body part 50 and hence relative to the orifice 58 in nozzle 57 or they may be secured to a pressure plate 68 rotatable in recess 69 formed in end face 56.

The deflecting members 65 and 66 are provided with chisel-like deflecting edges 67 and 68', which present a sharp edge to interfere with the jet issuing from the nozzle 58, and so form the jet to a desired shape.

On location of pressure plate 68, the deflecting members 65 and 66 in their respective positions on the end face 56, the cap member 74, provided with helical thread 75, is engaged on the helical thread 55 on outer end part 54 and secured in position. Thus pressure plate 68 and the deflecting members 65 and 66 are firmly secured in their correct position. The assembly is then ready for use and may be connected to a source of high pressure liquid.

If it is required to change the shape of the jet, the deflecting member 65 and 66 may be replaced by other deflecting members, as may the nozzle 57 or both to enable the formation in a desired form and shape of liquid jet.

Figure 5:
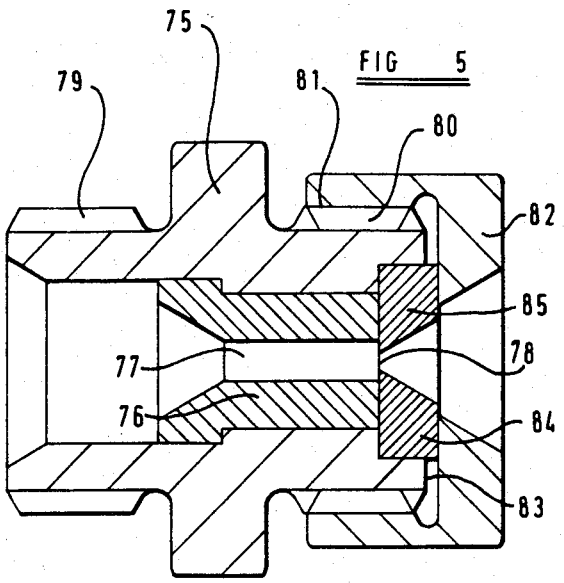
FIG. 5 is a sectional view illustrating a third embodiment of the invention.
Figure 6:
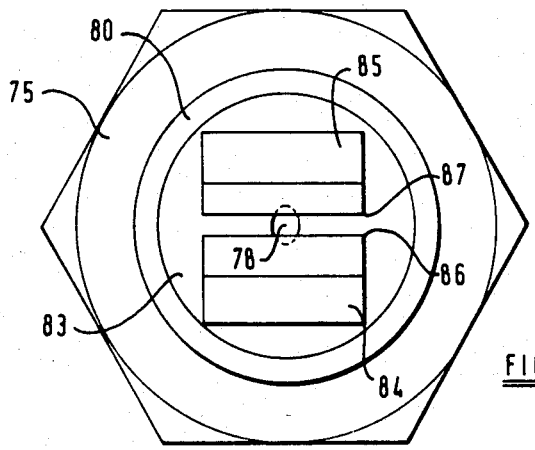
FIG. 6 is an end view of the emobodiment shown in FIG. 5 with the cap removed.

Referring now to FIGS. 5 and 6 a third embodiment of the invention comprises a body part 75 having a nozzle 76 located therein the nozzle 76 having a passage 77 through which liquid under high pressure may pass, the passage 77 ending in orifice 78.

The body part 75 is provided with a helical thread 79 for attachment to a source of high pressure fluid and a further thread 80 engaged by a corresponding thread 81 provided on cap member 82.

The end surface 83 of the body part 75 is recessed to accommodate deflecting members 84 and 85 each of which have respective sharp edges 86 and 87. The sharp edges 86 and 87 of deflecting members 84 and 85 overlap orifice 78.

The embodiment shown in FIGS. 5 and 6 is intended to produce a fan shaped jet and it has been found that an oval passage way 77 terminating in an oval orifice 78 in combination with deflecting members 84 and 85 overlapping the orifice 78 along the major axis thereof produces a highly satisfactory fan jet.

The deflecting members 84 and 85 may be provided with locating means in the end surface 83 of body part 85 and are secured in position by pressure exerted through threaded engagement of the cap member 82 with the thread 80 on body part 75.

In the embodiment illustrated there is no plate member between the cap member 82 and deflecting members 84 and 85 however it is envisaged that if desired such a plate member may be provided.

Figure 7:
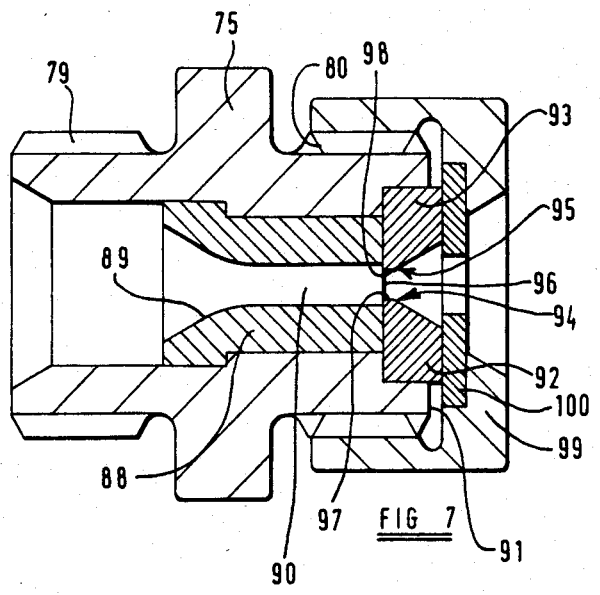
FIG. 7 is a sectional view of a fourth embodiment of the invention.

FIG. 7 illustrates a further embodiment the body parts 75 referred to in FIGS. 5 and 6 having the aforementioned helical thread forms 79 and 80.

The nozzle 88 has a curved entry profile 89 and a passageway once again of oval configuration however the cross-section of the passageway 90 may depend on the shape of jet required.

The deflecting members are once again located by a recess in the end face 91 of the body part 75, the deflecting members 92 and 93 having their respective sharp edges 94 and 95 overlapping orifice 96 of passageway 90. The sharp edges 94 and 95 of deflecting members 92 and 93 are provided with small flats or lands 97 and 98 respectively.

The deflecting members 92 and 93 are secured in position by cap member 99 bearing on the deflecting members 92 and 93 through the intermediary plate member 100.

The above described embodiments illustrate nozzles having either circular or oval cross-section passageways for the liquid. However it is envisaged that the cross-section of the passageway and the orifice may be of any suitable shape, i.e. square, rectangular, lobed, multi-sided etc.

Figure 8:
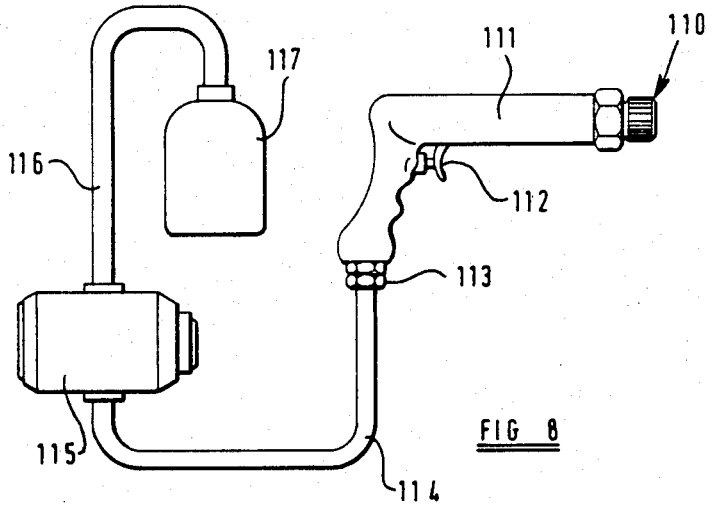
FIG. 8 is a schematic view of the jet forming apparatus connected to a source of pressure fluid.

FIG. 8 illustrates a jet deflecting nozzle 110 which may be as shown in any of the preceding drawings secured to a hand held "gun" 111.

The gun 111 has a trigger valve 112 and is attached by fitting 113 to pipe 114 which is connected to a high pressure pump 115.

Fluid from reservoir 117 flows to pump 115 through pipe 116.

It will be appreciated that the apparatus schematically shown in FIG. 8 is an example of a portable type device and the jet deflecting apparatus may also be used on fixed installations.

I claim:

1. Apparatus for deflecting a high pressure jet of liquid, comprising:

(a) a nozzle;

(b) an orifice in said nozzle through which liquid may pass to form said jet;

(c) said orifice having an inlet end for liquid and an outlet end;

(d) a pair of deflecting members, each of said deflecting members having an inlet-end facing surface and an outlet-end facing surface, said outlet-end facing surface being configured to form a chisel shaped end region of said deflecting member, which region terminates in a sharp edge;

(e) mounting means enabling mounting of said deflecting members relative to said outlet end of said nozzle;

(f) the deflecting members being positioned in a jet deflecting position by said mounting means so they are diametrically opposed to each other and so that a portion of each said chisel shaped end region projects into the path of said jet, each said outlet-end facing surface being inclined away from said sharp edge to prevent said jet, as it passes through a restrictive aperture formed by the opposed sharp edges, from adhering, by capillary action, to said deflecting member; and (g) securing means for firmly securing each deflecting member relative to said nozzle in said jet deflecting position.

2. Apparatus for deflecting a jet of liquid as claimed in claim 1 wherein said deflecting members are positioned in relation to said nozzle so that each abuts the nozzle in which said orifice is formed.

3. Apparatus for deflecting a jet of liquid as claimed in claim 1 further comprising a plate member, said securing means securing each deflecting member to said plate member and wherein said plate member is secured relative to the jet forming nozzle.

4. Apparatus as claimed in claim 3 wherein said plate member is secured relative to said jet forming nozzle in a manner such that said deflecting members are sandwiched between said nozzle and said plate member and wherein said plate member is dimensioned and positioned relative to said nozzle so as not to interfere with said jet of liquid.

5. Apparatus for deflecting a high pressure jet of liquid, comprising:

(a) a nozzle;

(b) an orifice in said nozzle through which liquid may pass to form said jet;

(c) said orifice having an inlet end for liquid and an outlet end;

(d) a pair of deflecting members, each of said deflecting members having an inlet-end facing surface and an outlet-end facing surface, said outlet-end facing surface being configured to form a chisel shaped end region of said deflecting member, which region terminates in a sharp edge;

(e) mounting means enabling mounting of said deflecting members relative to said outlet end of said nozzle;

(f) the deflecting members being positioned in a jet deflecting position by said mounting means so they are diametrically opposed to each other and so that a portion of each said chisel shaped end region projects into the path of said jet, each said outlet-end facing surface being inclined away from said sharp edge to prevent said jet, as it passes through a respective aperture formed by the opposed sharp edges, from adhering, by capillary action, to said deflecting member;

(g) securing means including a plate member for firmly securing each deflecting member relative to said nozzle in said jet deflecting position;

(h) a cap member; and (i) co-operating attachment means provided on said nozzle and on said cap member;

the arrangement being such that said cap member engages said nozzle so as to entrap and secure said plate member and each of said deflecting members and position said deflecting members relative to said jet forming orifice in a predetermined desired position.

6. Apparatus as claimed in claim 5 wherein said plate member and said deflecting members are dimensioned relative to the dimensions of said cap member so that the position of said deflecting members and said plate member relative to said jet forming orifice can be changed to any one of a number of different positions.

7. Apparatus for forming and shaping a high pressure jet of liquid, said apparatus comprising;

(a) a nozzle;

(b) an orifice in said nozzle through which liquid may pass to form said jet;

(c) said orifice having an inlet end for liquid and an outlet end;

(d) a pair of deflecting members, each of said deflecting members having an inlet-end facing surface and an outlet-end facing surface, said outlet-end facing surface being configured to form a chisel shaped end region of said deflecting member, which region terminates in a sharp edge;

(e) mounting means enabling mounting of said deflecting members relative to said outlet end of said nozzle;

(f) the deflecting members being positioned in a jet deflecting position by said mounting means so they are diametrically opposed to each other and so that a portion of each said chisel shaped end region projects into the path of said jet, each said outlet-end facing surface being inclined away from said sharp edge to prevent said jet, as it passes through a restrictive aperture formed by the opposed sharp edges, from adhering, by capillary action, to said deflecting member;

(g) securing means for securing each deflecting member relative to said nozzle in said jet deflecting position; and (h) a body member providing location means for said nozzle.

8. Apparatus for deflecting a jet of liquid as claimed in claim 7 wherein said orifice is oval in cross-section from said inlet end to said outlet end.

9. Apparatus as claimed in claim 1, claim 5, or claim 7 wherein the deflecting members are positioned relative to the jet and interfere therewith so as to cause cavitation in said jet.

10. Apparatus for forming and shaping a high pressure jet of liquid, said apparatus comprising;

(a) a nozzle;

(b) an orifice in said nozzle through which liquid may pass to form said jet;

(c) said orifice having an inlet end for liquid and an outlet end;

(d) a pair of deflecting members, each of said deflecting members having an inlet-end facing surface and an outlet-end facing surface, said outlet-end facing surface being configured to form a chisel shaped end region of said deflecting member, which region terminates in a sharp edge;

(e) mounting means enabling mounting of said deflecting members relative to said outlet end of said nozzle;

(f) the deflecting members being positioned in a jet deflecting position by said mounting means so they are diametrically opposed to each other and so that a portion of each said chisel shaped end region projects into the path of said jet, each said outlet-end facing surface being inclined away from said sharp edge to prevent said jet, as it passes through a restrictive aperture formed by the opposed sharp edges, from adhering, by capillary action, to said deflecting member;

(g) securing means for firmly securing each deflecting member relative to said nozzle in said jet deflecting position;

(h) a body part;

(i) location means for locating said nozzle in said body part;

(j) a cap member threadably locatable on said body part to secure said deflecting members in their jet deflecting position; and (k) a pressure plate situated between said deflecting members and said cap member through which said cap member bears on said deflecting members.

11. Apparatus for deflecting a jet of liquid as claimed in claim 1 wherein said orifice is oval in cross-section from said inlet end to said outlet end.

* * * * *

UNITED STATES PATENT AND TRADEMARK OFFICE

CERTIFICATE OF CORRECTION

PATENT NO. : 4,607,794

DATED : August 26, 1986

INVENTOR(S) : Norman Horwood

It is certified that error appears in the above-identified patent and that said Letters Patent is hereby corrected as shown below:

Column 7, line 56, delete "respective" and insert therefor --restrictive--.

Signed and Sealed this

Sixteenth Day of December, 1986

*Attest:*

DONALD J. QUIGG

*Attesting Officer* *Commissioner of Patents and Trademarks*